US006716088B2

(12) United States Patent
Jinbu et al.

(10) Patent No.: US 6,716,088 B2
(45) Date of Patent: Apr. 6, 2004

(54) WORK PROCESSING METHOD

(75) Inventors: Yasuhiko Jinbu, Wako (JP); Koichi Oku, Wako (JP); Takeshi Morioka, Wako (JP)

(73) Assignee: Honda Giken Kogyo Kabushiki Kaisha, Tokyo (JP)

( * ) Notice: Subject to any disclaimer, the term of this patent is extended or adjusted under 35 U.S.C. 154(b) by 143 days.

(21) Appl. No.: 10/040,897

(22) Filed: Jan. 9, 2002

(65) Prior Publication Data

US 2002/0090897 A1 Jul. 11, 2002

(30) Foreign Application Priority Data

Jan. 10, 2001 (JP) ..... 2001-002973
Oct. 24, 2001 (JP) ..... 2001-326791

(51) Int. Cl.[7] ..... B24B 1/00

(52) U.S. Cl. ..... 451/51; 451/58; 451/61; 451/67; 451/180

(58) Field of Search ..... 82/1.11, 1.2; 407/35, 407/42; 451/5, 51, 52, 57, 58, 61, 65, 66, 67, 140, 143, 150, 162, 170, 173, 180

(56) References Cited

U.S. PATENT DOCUMENTS 5,015,130 A * 5/1991 Matsuura et al. ..... 409/80
5,406,494 A * 4/1995 Schuett ..... 700/188
5,651,720 A * 7/1997 Shinomoto et al. ..... 451/8
6,077,002 A * 6/2000 Lowe ..... 409/132
6,506,005 B2 * 1/2003 Kawai et al. ..... 409/131

FOREIGN PATENT DOCUMENTS

JP 11-90713 4/1999
JP 11-309602 11/1999

* cited by examiner

*Primary Examiner*—Timothy V. Eley
(74) *Attorney, Agent, or Firm*—Arent Fox Kintner Plotkin & Kahn, PLLC

(57) ABSTRACT

A processing apparatus capable of grinding an arcuate groove (a groove having an arcuate shape in section) of various shapes defined in a work with a good accuracy. A pseudo-elliptic arcuate groove defined in a work is ground by a forming grindstone. The work is moved in a Y-axis direction (vertically on a paper sheet) in a state in which the forming grindstone is supported on a tool table for rotation and is moved in a X-axis direction (a direction perpendicular to the paper sheet) to abut against the arcuate groove, while rotating the work in a direction of an arrow with its axis L matched with an axis C of an indexer. Thus, it is possible to relatively move the forming grindstone to trace the arcuate groove, thereby accurately grinding the arcuate groove.

6 Claims, 11 Drawing Sheets

P
81
49
14
C(L)
52
51
GROUND PORTION
ΔY1
ΔY2
C-AXIS
LOWER LIMIT POSITION
C-AXIS
UPPER LIMIT POSITION

WORK PROCESSING METHOD

BACKGROUND OF THE INVENTION

1. Field of the Invention

The present invention relates to a method for grinding an arcuate groove (a groove having an arcuate shape in section) defined in a work.

2. Description of the Related Art

One example of a method for forming an arcuate groove (a groove having an arcuate shape in section) in a surface of a work is a ball end milling by a machining center. This method is intended to grind an arcuate groove by moving a ball end mill in any locus along the surface of the work.

A method for cutting a spherical surface of a work by a formed cutting tool having a spring necked mechanism is described in Japanese Patent Application Laid-open No.11-90713.

An NC processing apparatus is also described in Japanese Patent Application Laid-open No.11-309602, and is comprised of a Z-axis table adapted to move a main shaft table having a main shaft for rotatably supporting a work in a Z-axis direction parallel to the main shaft. It further comprises an X-axis table adapted to move a turner supporting a cutting tool in an X-axis direction perpendicular to a Z-axis. With this NC processing machine, it is possible to form an axially asymmetric spherical surface in a work in a cutting manner by moving the cutting tool in the Z-axis direction, while moving the X-axis table in the X-axis direction in a state in which the Z-axis table has been fixed.

In processing the arcuate groove by the ball end mill, the feed pitch of the ball end mill is interpolated by a straight line. For this reason, the arcuate groove is not formed into a smooth arcuate shape. A processed line (a difference in level) corresponding to the feed pitch is produced in a depthwise direction of the feed pitch, resulting in a reduced processing quality of the arcuate groove. If the feed pitch is decreased in order to increase the processing quality, then the problem of a prolonged processing time exists.

In the method described in Japanese Patent Application Laid-open No.11-90713, the processing accuracy of the spherical surface by the formed cutting tool is improved. However, when the cutting tool is worn due to the cutting, the processing quality is thereby reduced. It is difficult to cut a material having a high hardness by the cutting tool, and there is also another problem of a hindrance to the cutting of such material.

In the method described in Japanese Patent Application Laid-open No.11-309602, the cutting is conducted by the cutting tool. Therefore, the same problems with respect to the wearing of the cutting tool are present.

In either case, when the arcuate groove has been cut in the work, it is necessary to conduct the grinding of the arcuate groove by a grindstone in order to reduce relative roughness in the cut surface of the arcuate groove.

SUMMARY OF THE INVENTION

The present invention has been accomplished with the above circumstance in view. Therefore, it is an object of the present invention to provide a processing apparatus capable of grinding an arcuate groove of any of various shapes defined in a work with a good accuracy.

To achieve the above objective, the present invention provides, for example, a method for processing an arcuate groove defined in a surface of a work so that an arc of a circle having a given radius is continuously smooth, the method using a forming grindstone to be rotated about a rotary shaft parallel to an X-axis and having the same radius as the arc of the circle, a tool table movable in the X-axis direction and in a Z-axis direction perpendicular to the X-axis with the forming grindstone supported thereon, and an indexer mounted to support the work such that the indexer is opposed to the forming grindstone in the Z-axis direction, and the indexer is moved in an Y-axis direction perpendicular to the X-axis and the Z-axis, and rotates the work W about a C-axis. The method comprises the steps of rotating the work about the C-axis, synchronizing the movement of the grindstone in the Z-axis direction, with at least one of the movement of the work in the Y-axis direction, and with the movement of the forming grindstone in the X-axis direction, and moving the forming grindstone to trace the arcuate groove.

With the above feature, the rotation of the work about the C-axis, whereby the movement of the grindstone in the Z-axis direction, and at least one of the movement of the work in the Y-axis direction, and the movement of the forming grindstone in the X-axis direction, are synchronized with one another. Accordingly, the forming grindstone is moved to trace the arcuate groove, thereby conducting the grinding of the arcuate groove. Therefore, the arcuate groove can be ground with a high accuracy. Also, it is possible to accommodate any arcuate groove of various shapes, which may lead to enhanced general-purpose properties.

The present invention also provides a work processing method including the step of moving the work in the Y-axis direction when an option between moving the work in the Y-axis direction and moving the forming grindstone in the X-axis is available.

With the above feature, it is possible to accommodate the grinding of any arcuate groove of various shapes, while maintaining the section of the arcuate groove perpendicular to a tangent direction at a shape of an exact arc of a circle, by moving the work in the Y-axis direction.

The present invention further provides a work processing method including the step of moving the forming grindstone in the X-axis direction when an option between moving the work in the Y-axis direction and moving the forming grindstone in X-axis direction is available.

With the above feature, it is possible to change the rotating surface of the forming grindstone as desired with respect to the section of the arcuate groove perpendicular to the tangent direction by moving the work in the X-axis direction, thereby accommodating the grinding of an arcuate groove elliptic in section.

In addition, the present invention provides a work processing method including the step of moving both the work in the Y-axis direction and moving the forming grindstone in the X-axis direction.

With the above feature, both of the movement of the work in the Y-axis direction and the movement of the forming grindstone in the X-axis direction are conducted. Therefore, it is possible to accommodate various shapes of the grinding of an arcuate groove, while maintaining the section of the arcuate groove perpendicular to the tangent direction. Moreover, it is possible to change the rotating surface of the forming grindstone as desired with respect to the section of the arcuate groove perpendicular to the tangent direction, thereby accommodating the grinding of an arcuate groove elliptic in section.

Furthermore, the present invention provides a work processing method including the steps of, for example, mounting a tool other than the forming grindstone on the tool table; and processing the work supported on the indexer by the tool.

With the above feature, the work supported on the indexer is processed by the tool other than the forming grindstone mounted on the tool table. Therefore, it is possible to conduct the grinding of the arcuate surface by the forming grindstone and the processing of the arcuate surface by the other tool without mounting and the removal of the work on and from the indexer. As such, this leads to an enhanced operability. Moreover, the grinding of the arcuate surface by the forming grindstone and the processing of the arcuate surface by the other tool can be carried out at the same processing standard, leading to an enhanced processing accuracy.

The present invention also provides a work processing method in which the tool is any one of a grindstone-type tool, a milling-type tool and a lathe-type tool.

With the above feature, it is possible to use each one of the grindstone-type tool, the milling-type tool and the lathe-type tool of the present invention, which leads to a substantially enhanced convenience.

DETAILED DESCRIPTION OF THE INVENTION

Figure 1:
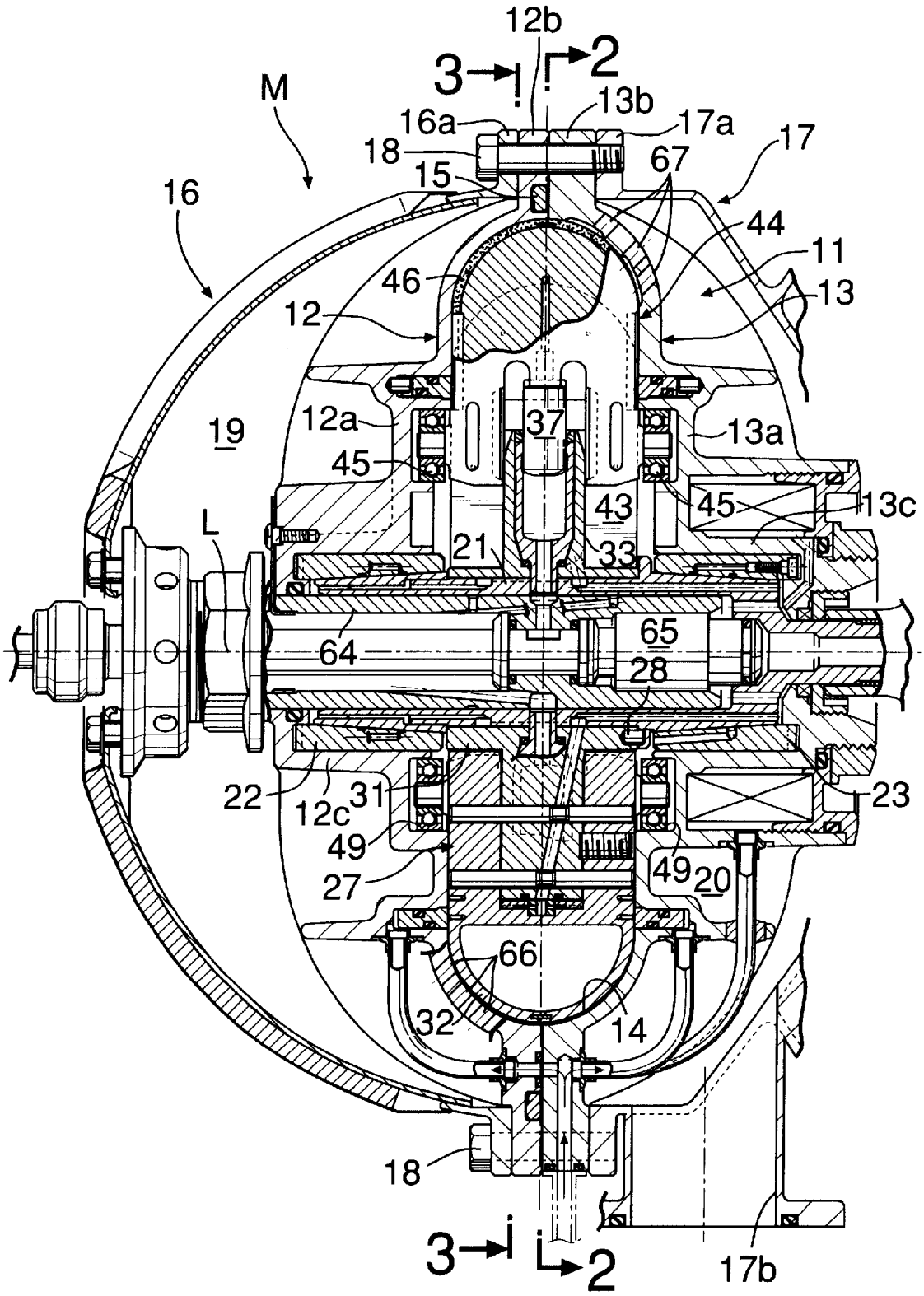
FIG. 1 is a vertical sectional view of an expanding machine.
Figure 2:
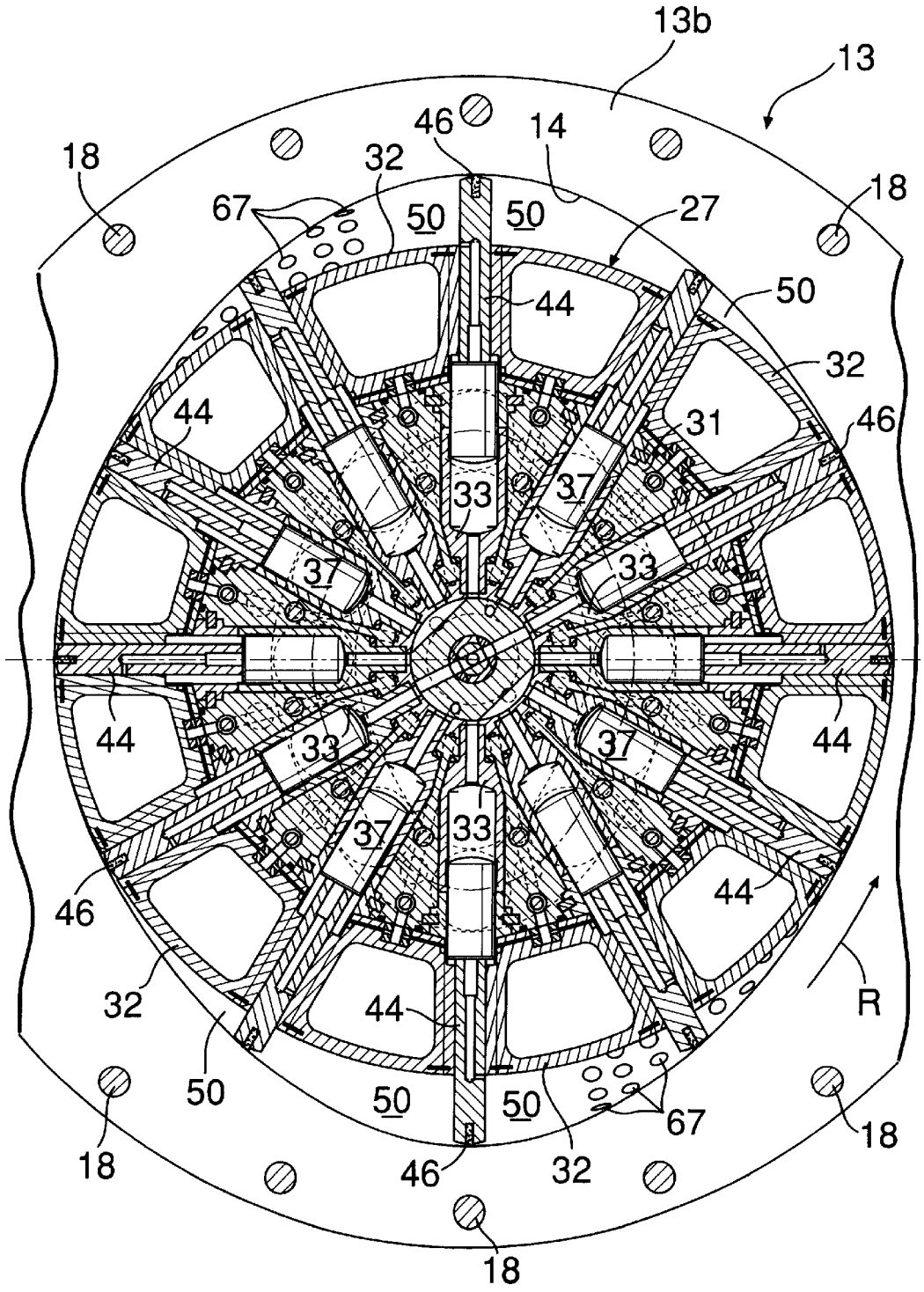
FIG. 2 is a view taken along line 2—2 in FIG. 1.
Figure 3:
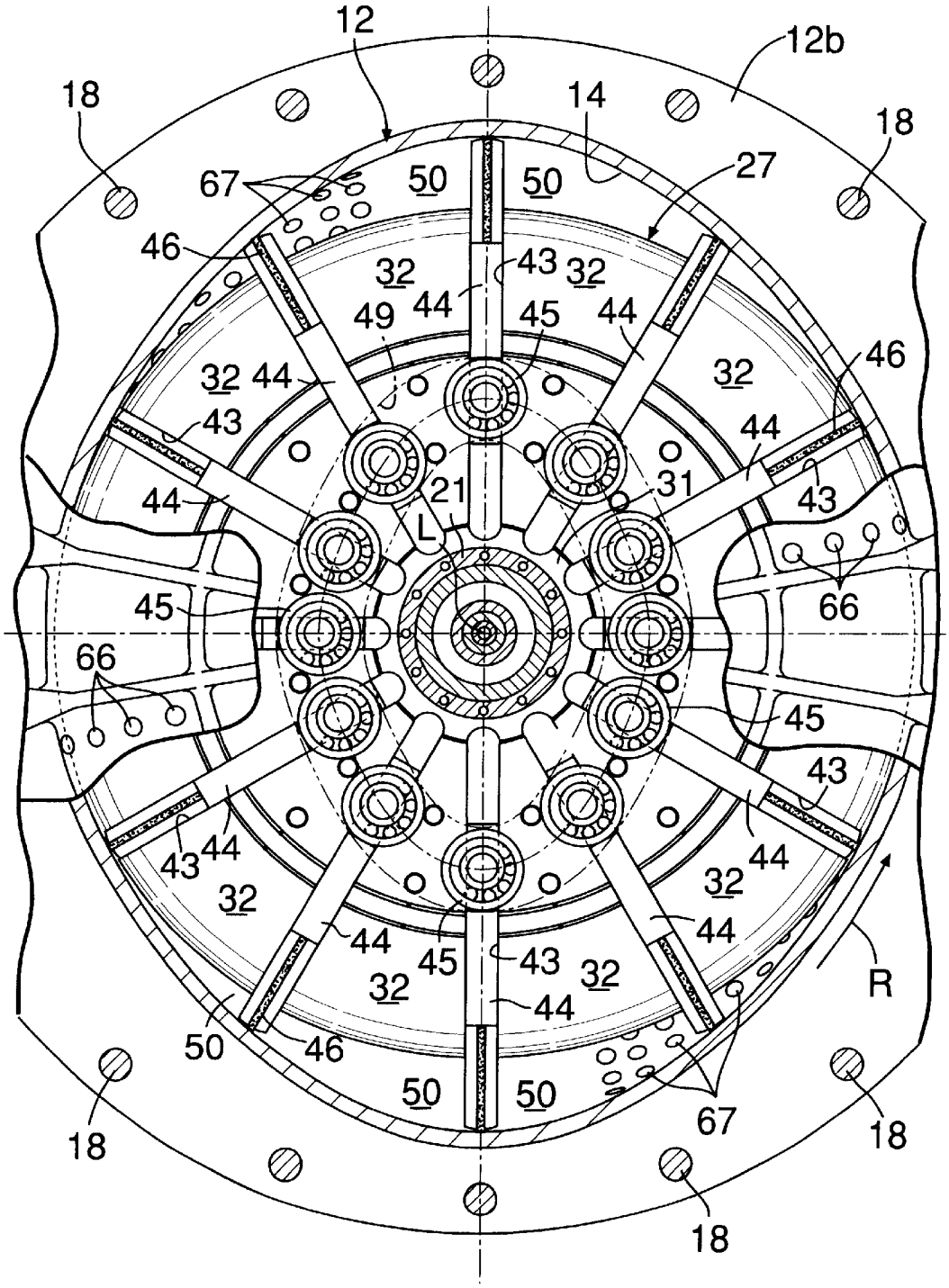
FIG. 3 is a sectional view taken along line 3—3 in FIG. 1.
Figure 4:
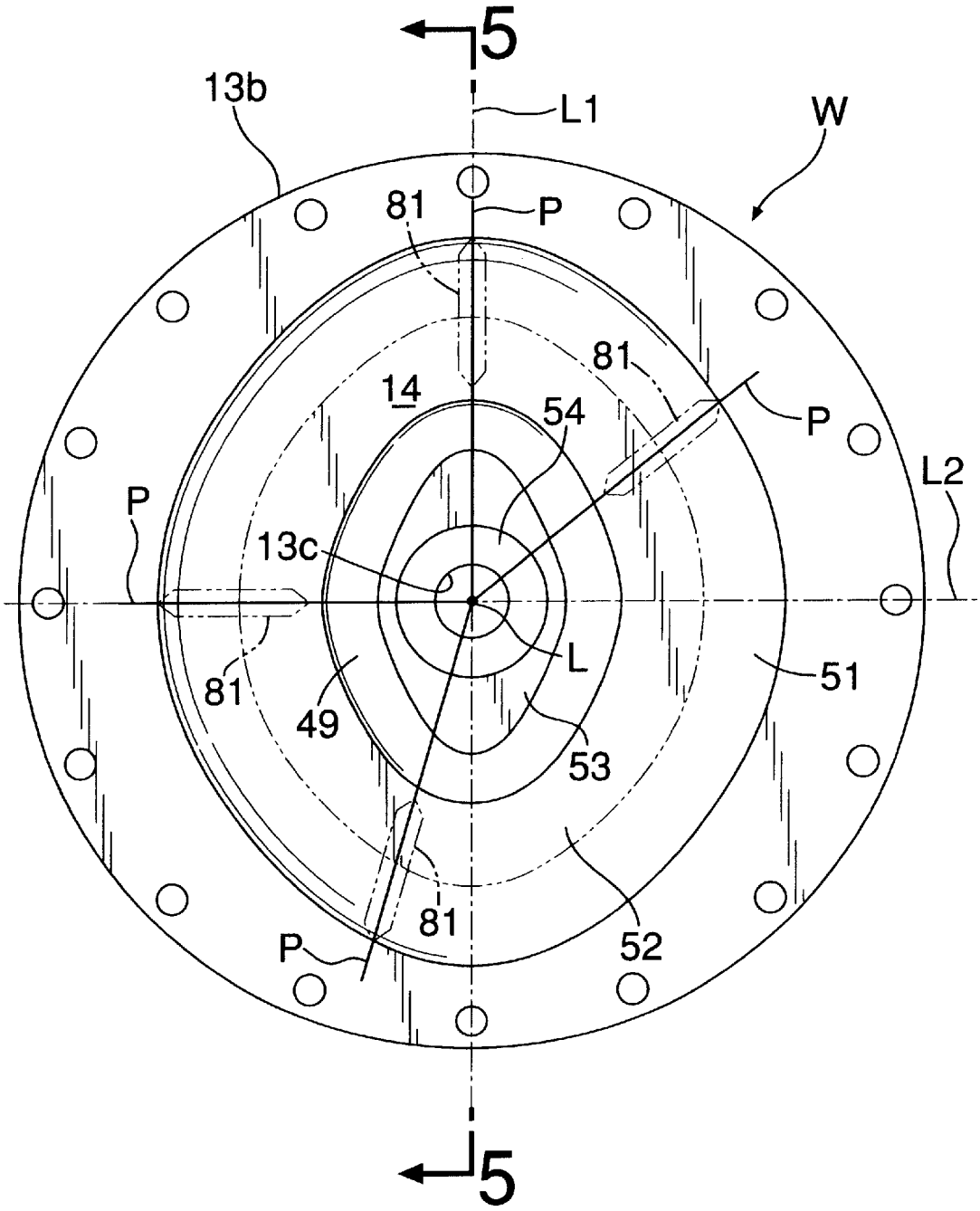
FIG. 4 is a front view of a second half casing of the expanding machine.
Figure 5:
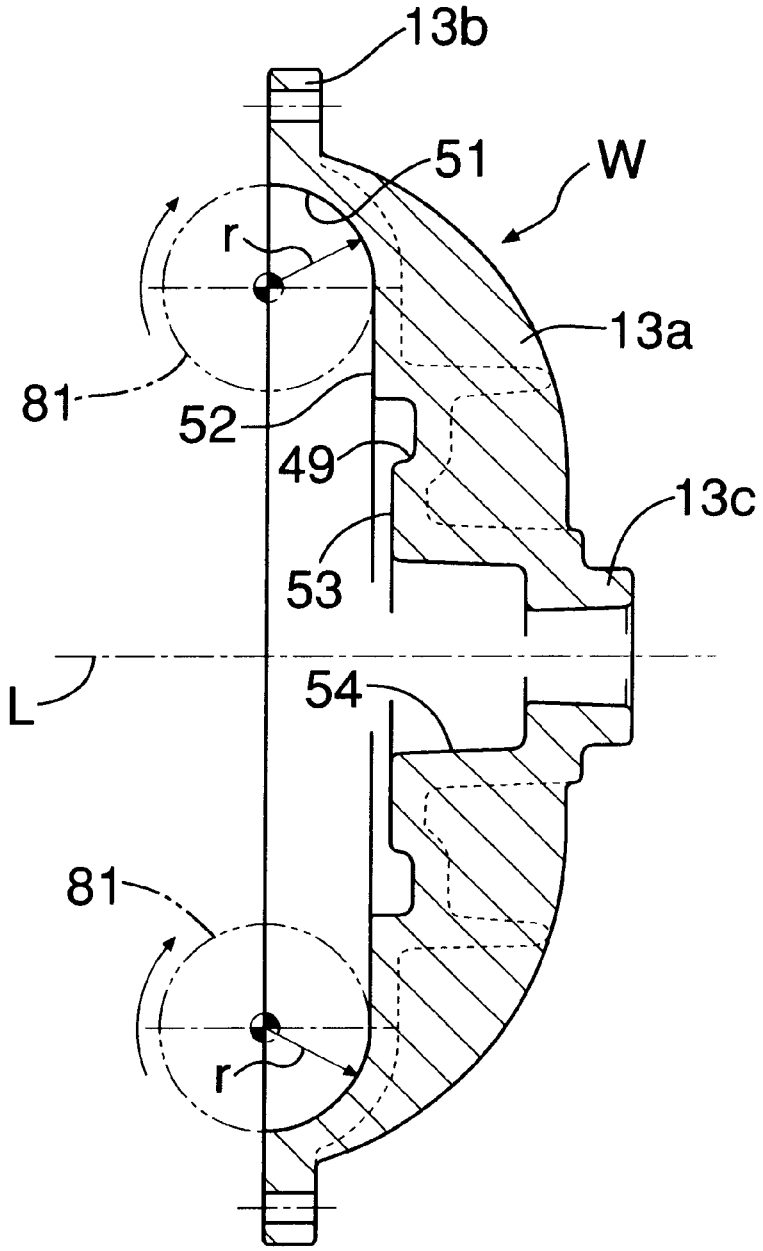
FIG. 5 is a sectional view taken along line 5—5 in FIG. 4.
Figure 6:
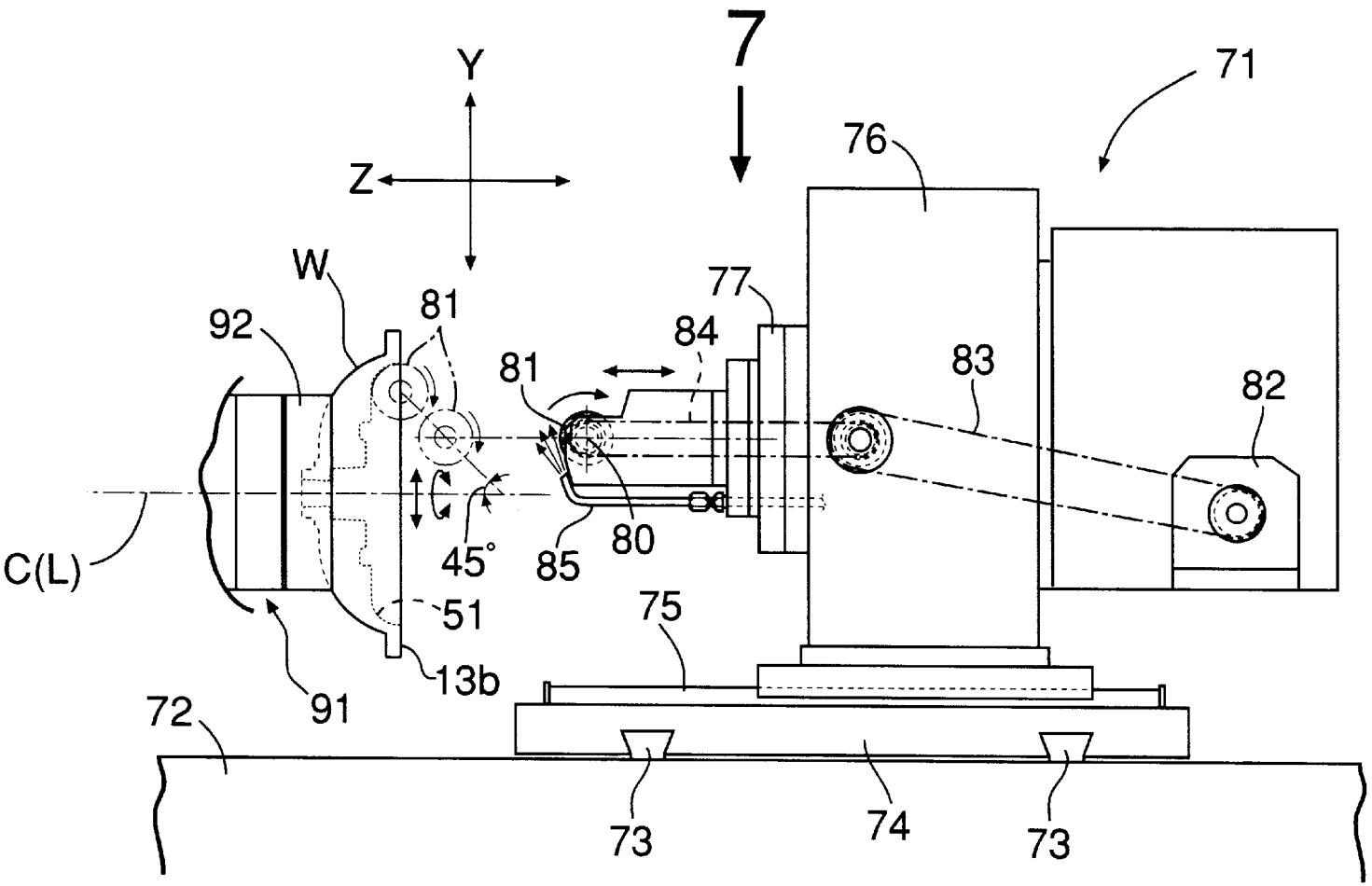
FIG. 6 is a side view of the entire processing apparatus.
Figure 7:
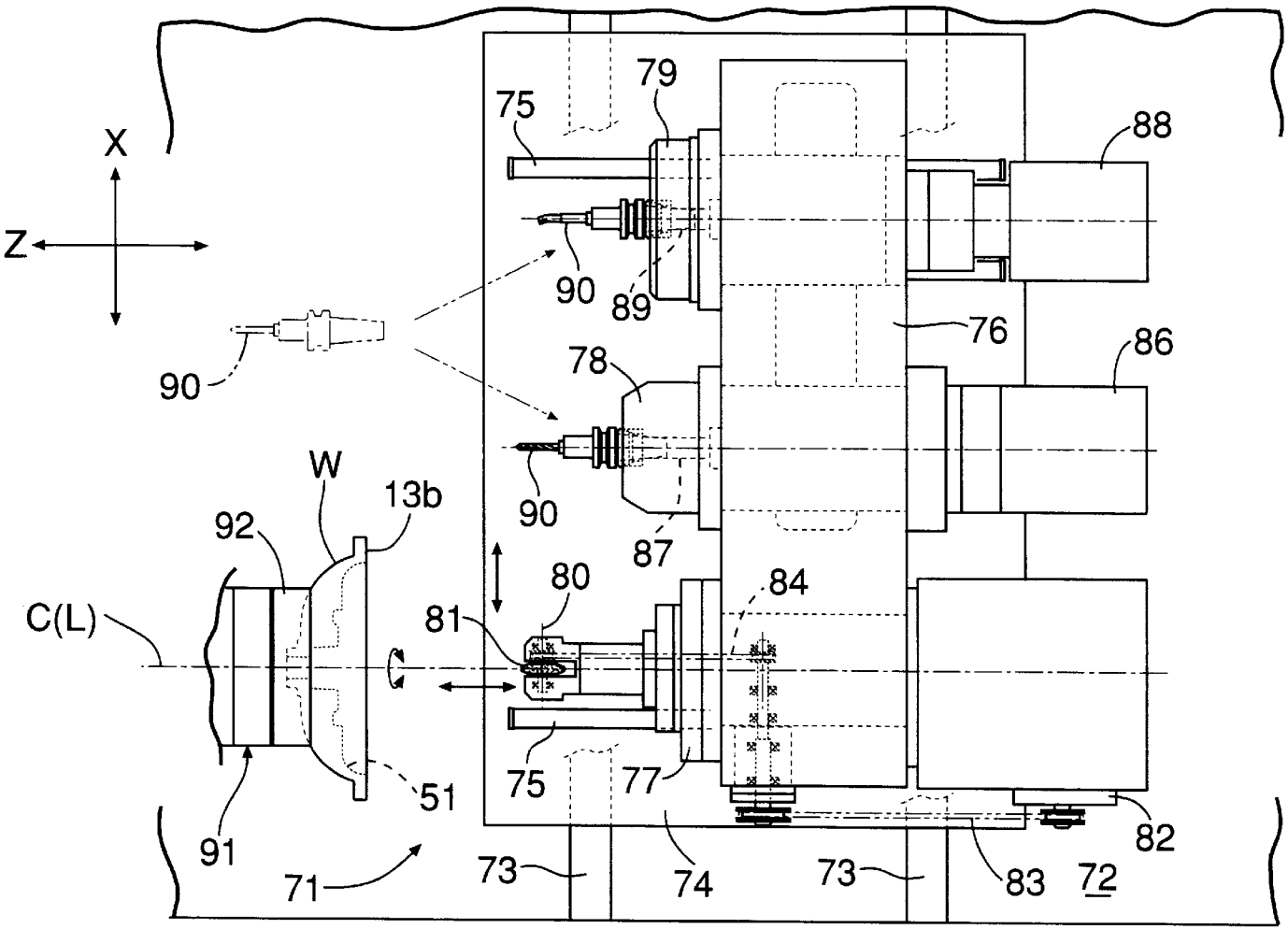
FIG. 7 is a view taken from the direction of arrow 7 in FIG. 6.
Figures 8A, 8B, 8C:
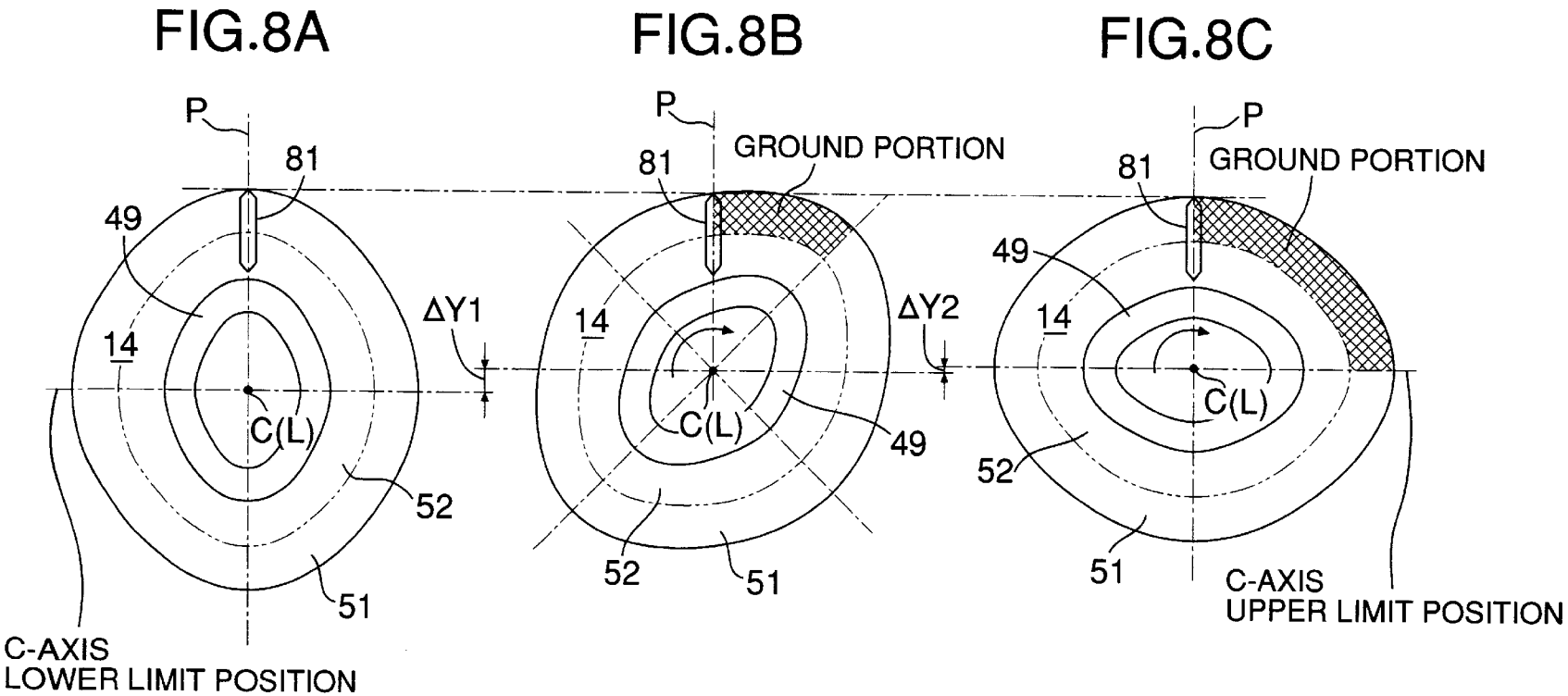
FIGS. 8A, 8B and 8C are diagrams explaining the operation during the grinding of an arcuate groove.

FIGS. 1 to 8C show a first embodiment of the present invention. FIG. 1 is a vertical sectional view of an expanding machine; FIG. 2 is a view taken along line 2—2 in FIG. 1; FIG. 3 is a sectional view taken along line 3—3 in FIG. 1; FIG. 4 is a front view of a second half casing of the expanding machine; FIG. 5 is a sectional view taken along line 5—5 in FIG. 4; FIG. 6 is a side view of the entire processing apparatus; FIG. 7 is a view taken from a direction of an arrow 7 in FIG. 6; FIGS. 8A, 8B and 8C are diagrams for explaining the operation during cutting of an arcuate groove.

First, the entire structure of an expanding machine M, in which first and second casing halves 12 and 13 constituting a work W in the present embodiment are incorporated, will be described with reference to FIGS. 1 to 3.

A casing 11 in the expanding machine M is comprised of a first and a second half casing 12 and 13 made of metal. The half casings 12 and 13 comprise body portions 12*a*, 13*a* defining a rotor chamber 14 by cooperating with each other, and circular flanges 12*b*, 13*b* integrally leading to an outer peripheries of the body portions 12*a*, 13*a*, respectively. The circular flanges 12*b* and 13*b* are coupled to each other through a metal gasket 15. An outer surface of the first half casing 12 is covered with a relay chamber outer wall 16 having a deep bowl-shape, and a circular flange 16*a* integrally leading to an outer periphery of the chamber outer wall 16 is superposed on the left side of the circular flange 12*b* of the fist half casing 12. An outer surface of the second half casing 13 is covered with a discharge chamber outer wall 17 which houses a magnet coupling for transmitting an output from the expanding machine M to the outside. A circular flange 17*a* integrally leading to an outer periphery of the discharge chamber outer wall 17 is superposed on the right side of the circular flange 13*a* of the second half casing 13. The four flanges 12*a*, 13*a*, 16*a* and 17*a* are commonly clamped by a plurality of bolts 18 disposed circumferentially.

A relay chamber 19 is defined between the relay chamber outer wall 16 and the first half casing 12. Additionally, a discharge chamber 20 is defined between the discharge chamber outer wall 17 and the second half casing 13. The discharge chamber outer wall 17 has a discharge outlet 17*b* provided therein for discharging vapor that has finished its work in the expanding machine M. The body portions of the half casings 12 and 13 have hollow bearing sleeves 12*c* and 13*c* protruding outwards, respectively. A hollow rotary shaft 21, relatively rotatably fitted over the outer peripheries of a first stationary shaft 64 and a second stationary shaft 65, is rotatably carried on the hollow bearing sleeves 12*c* and 13*c* with a pair of bearing members 22 and 23 interposed therebetween.

A rotor 27 of a circular shape is rotatably accommodated within the rotor chamber 14 of a pseudo-elliptic shape. The rotor 27 is fitted over an outer periphery of the rotary shaft 21 and integrally coupled to the outer periphery by a pin 28. An axis of the rotor 27 and an axis of the rotor chamber 14 are matched with an axis L of the rotary shaft 21. The rotor 27 is comprised of a rotor core 31 fixed to the outer periphery of the rotary shaft 21, and twelve rotor segments 32 fixed to cover a periphery of the rotor core 31 forming the contour of the rotor 17. Twelve cylinders 33 made of ceramic are mounted to the rotor core 31 radially at distances of 30°. A piston 37 made of ceramic is slidably received in each of the cylinders 33.

Twelve vane grooves 43 are defined between the adjacent rotor segments 32 of the rotor 27 to extend radially, and the plate-shaped vanes 44 are slidably fitted in the vane grooves 43, respectively. Rollers 45, 45 having a roller bearing structure, are rotatably carried on a pair of support shafts protruding from each of the vanes 44. A U-shaped seal member 46 made of a synthetic resin is retained in the tip end of each of the vanes 44, wherein the tip end is in sliding contact with an inner surface of the rotor chamber 14. Pseudo-elliptic annular grooves 49, 49 are provided in a recessed manner in the rotor chamber 14 demarcated by the first and second half casings 12 and 13, and a pair of rollers 45, 45 on each of the vanes 44 are rollably engaged in the annular grooves 49, 49. The distance between the annular grooves 49, 49 and the inner peripheral surface of the rotor chamber 14 is uniform over the entire periphery. Therefore, when the rotor 27 is rotated, the vanes 44 with the rollers 45, 45 are guided by the annular grooves 49, 49 and are moved reciprocally radially within the vane grooves 43. Furthermore, the seal members 46 of the vanes 44 slid along the inner peripheral surface of the rotor chamber 14 in their states in which they have been compressed in a given amount.

A plurality of suction ports 66 are defined and arranged radially in the first half casing 12 at locations advanced by 15° in a direction R of the rotation of the rotor 27 with respect to the shortest diameter of the rotor chamber 14. The internal space in the rotor chamber 14 is permitted to communicate with the relay chamber 19 by the suction ports 66. A plurality of discharge ports 67 are defined and arranged radially in a plurality of rows in the second half casing 13 at locations delayed by 15° to 75° in the direction R of the rotation of the rotor 27 with respect to the shortest diameter of the rotor chamber 14. The internal space in the rotor chamber 14 is permitted to communicate with the discharge chamber 20 by the discharge ports 67.

The operation of the expanding machine M having the above-described arrangement will be described below. The high-temperature and high-pressure vapor fed into the first stationary shaft 64 is supplied via a rotary valve formed between the slide surfaces of the first stationary shaft 64 and the rotary shaft 21. The high-temperature and high-pressure vapor are fed into the two cylinders 33 located in positions on a line corresponding to the short diameter of the rotor chamber 14 thereby urging the pistons 37, 37 radially outwards. When the vanes 44, 44 urged by the pistons 37, 37 are moved radially outwards, the advancing motion of the pistons 37, 37 is converted into the rotating motion of the rotor 27 by the engagement of the pair of rollers 45, 45 mounted on the vanes 44, 44 and the annular grooves 49, 49 with each other.

The pistons 37, 37 are further advanced by the further continuation of the expansion of the high-temperature and high-pressure vapor in the cylinders 33, 33 with the rotation of the rotor 27 in a direction of an arrow R, whereby the rotation of the rotor 27 is continued. After the vanes 44, 44 have reached their positions on a line corresponding to a long diameter of the rotor chamber 14, the pistons 37, 37 are urged into the cylinders 33, 33 by the rollers 45, 45 engaged in the annular grooves 33, 33, whereby the vapor in the cylinders 33, 33 is passed through the rotary valve and is supplied in the form of a first dropped-temperature and dropped-pressure vapor into the relay chamber 19. The first dropped-temperature and dropped-pressure vapor has a heat energy and a pressure energy lower than those of the high-temperature and high-pressure vapor, but which is still enough to drive the vanes 44.

The first dropped-temperature and dropped-pressure vapor in the relay chamber is supplied through the suction ports 66 in the first half casing 12 and into the vane chamber 50 within the rotor chamber 14. In other words, the first dropped-temperature and dropped-pressure vapor in the relay chamber is supplied into a space demarcated by the rotor 27 and the pair of adjacent vanes 44, 44, where it is further expanded to rotate the rotor 27. A second dropped-temperature and dropped-pressure vapor is derived from the first dropped-temperature and dropped-pressure vapor, wherein the second dropped-temperature and dropped-pressure vapor upon finishing its work further drops in temperature and pressure and is subsequently discharged through the discharge ports 67 in the second half casing 13 into the discharge chamber 20, and thereby discharged from the discharge chamber 20 via the discharge outlet 17*b*.

In this way, an output is obtained from the rotary shaft 21 by rotating the twelve pistons 37 sequentially by the expansion of the high-temperature and high-pressure vapor to rotate the rotor 27 through the rollers 45, 45 and the annular grooves 49, 49, and further rotating the rotor 27 through the vanes 44 by the expansion of the first dropped-temperature and dropped-pressure vapor which are derived from the high-temperature and high-pressure vapor dropping in temperature and pressure.

FIGS. 4 and 5 show the second half casing 13 as a work. The second half casing 13 will be called a work W hereinafter. The first half casing 12 has substantially the same shape as the second half casing 13, and therefore, the first half casing 12 also constitutes the work W.

The work W includes the circular flange 13*b*, and a rotor chamber 14 which is depressed in a recessed manner radially inside the circular flange 13*b*. The rotor chamber 14 is formed with a pseudo-elliptic arcuate groove 51, a first flat face 52 adjoining the inner side of the arcuate groove 51, an annular groove 49 adjoining an inner side of the first flat face 52, a second flat face 53 adjoining an inner side of the annular groove 49, and a hollow bearing sleeve 13*c* leading to an inner side of the second flat face 53 through a recess 54.

The rotor chamber 14 is symmetrical with a long axis L1 and a short axis passing through the axis L. The arcuate groove 51 constituting an outer portion of the rotor chamber 14 has a section, taken in any plane P (see FIG. 4) passing through the axis L, which is an arc of a circle having a center angle of 90° and a radius r. Of the arcuate groove 51 and the first flat face 52 defining the recess 54, the arcuate groove 51 is in sliding contact with the arcuate seal member 46 mounted at the tip end of the vane 44 and having a center angle of 180° and the radius r. The first flat face 52 is in sliding contact with a flat side end face of the vane 44. In this case, when the vanes 44 are rotated about the axis L, they are located on any plane P (see FIG. 4) passing through the axis L, because they are arranged radially about the axis L. Thus, the seal member 46 having the arcuate shape of the radius R, and the arcuate groove 51 of the radius R can be put in contact with each other without any gap.

As shown in FIGS. 6 and 7, the processing apparatus 71 includes a slide table 74 which is movable in a direction of an X-axis (in a direction perpendicular to a paper sheet surface of FIG. 6) along guide rails 73, 73 which are mounted on an upper surface of a stationary table 72. The processing apparatus 71 further includes a tool table 76 which is movable in a direction of a Z-axis (a lateral direction in FIG. 6). In other words, the processing apparatus 71 moves in directions of the X-axis and a Z-axis relative to the stationary table 72 through guide rails 75, 75 mounted on an upper surface of the slide table 74. The tool table 76 is provided with a plurality of (e.g., three) spindle stocks 77, 78 and 79. The positions of the tool table 76 in the X-axis and Z-axis directions are controllable in a unit of 0.001 mm, respectively.

A forming grindstone 81 having the radius r and adapted to be rotated about the rotary shaft 80 which extends in the Y-axis direction is mounted at the tip end of the first spindle stock 77 extending in the Z-axis direction. The forming grindstone 81 comprises a CBN electrodeposited grindstone, and is connected to and rotated by a motor 82 through two endless belts 83 and 84. The rotational speed of the forming grindstone 81 is variable up to a maximum value of 18,000 rpm by an inverter control. A grinding oil is supplied through a grinding-oil supply pipe 85 to the tip end of the forming grindstone 81.

The second spindle stock 78 has a spindle 87 extending in the Z-axis direction and rotated by a motor 86, and the third spindle stock 79 has a spindle 89 extending in the Z-axis direction and rotated by the motor 88. A tool 90 of a grindstone-type including a disk-shaped grindstone and a shaft-shaped grindstone or of a milling-type including a drill and an end-mill is exchangeably mounted on the spindles 87 and 89 of the second and third spindle stocks 78 and 79.

An indexer 91 is mounted on one side of the tool table 76 in the Z-axis direction and is capable of being indexed about a C-axis parallel to the Z-axis and capable of moving in the Y-axis direction (in a vertical direction in FIG. 6). The circular flange 13*b* of the work W is detachably supported on a chuck 92 of the indexer 91 and is parallel to an X-Y plane. Namely, the work W is fixed to the chuck 92, so that its axis L is matched with the C-axis. The rotated position of the indexer 91 about the C-axis is controllable in a unit of 0.001°, and the position of the indexer 91 in the Y-axis direction is controllable in a unit of 0.001 mm.

The grinding of the arcuate groove 51 in the work W by the processing apparatus 71 will be described below.

The work W is provided after finishing the cutting of the recess 14, and is fixed to the chuck 92 of the indexer 91, so that its axis L is matched with the C-axis. The position of the tool table 76 in the X-axis direction is adjusted so that the rotating surface of the forming grindstone 81 is located in a Y-Z plane passing through the C-axis. Furthermore, the height of the indexer 91 in the Y-axis direction is adjusted to a phantom line in which the rotational center of the forming grindstone 81 forms an angle of 45° with respect to the axis L. In this state, while the forming grindstone 81 is being rotated, the tool table 76 is advancing a predetermined distance in the Z-axis direction synchronously with the Y-axis to trace the phantom line in which the rotational center of the forming grindstone 81 forms a 45° angle with respect to the axis L. The grindstone 81 is put into abutment against the work W at a location corresponding to the arcuate groove 51. Thereafter, while the work W is being rotated, the indexer 91 is moved upwards and downwards twice in the Y-axis direction synchronously with the rotation of the work W. In this manner, the grinding of the entire periphery of the arcuate groove 51 can be completed by one rotation of the work W. During this time, the position of the forming grindstone 81 in the Z-axis direction is fixed, and the angle of rotation of the work W about the C-axis and the position of the work W in the Y-axis direction are numerically controlled so that they are synchronized with each other. From the forgoing, the forming grindstone 81 can grind the arcuate groove 51 in such a manner that it always follows the arcuate groove 51.

This will be further described with reference to FIG. 8. As shown in FIG. 8A, the grinding of the arcuate groove 51 is started at a position corresponding to the longer diameter of the recess 14. At this time, the C-axis of the indexer 91 is in the lower limit position of the Y-axis direction. As shown in FIG. 8*b*, the forming grindstone 81 is relatively moved to follow the arcuate groove 51 by lifting the C-axis of the indexer 91 by ΔY1 in the Y-axis direction from the lower limit position, while rotating the work W in a direction of the arrow. When the work W has been rotated through 90° in the direction of the arrow, as shown in FIG. 8*c*, the C-axis of the indexer 91 is lifted further by ΔY2 in the Y-axis direction to reach an upper limit position. When one fourth of the arcuate groove 51 is ground in the above manner, the C-axis is moved from the upper limit position to the lower limit position, while rotating the work W further through 90°. The forming grindstone 81 can be moved to follow the next one fourth of the arcuate groove 51 to grind it. The grinding of the remaining one half of the arcuate groove 51 is carried out by substantially repeating the above-described operation.

At this time, the rotating surface of the forming grindstone 81 lies in the plane P passing through the C-axis (namely, the axis L of the work W). Therefore, the angle of the rotating surface of the forming grindstone 81 with respect to the arcuate groove 51 is equal to the angle of the vane 44 sliding within the arcuate groove 51 during operation of the expanding machine M (in fact, the angle of the seal member 46 mounted on the peripheral portion of the vane 44). Accordingly, the inner surface (having the radius r) of the ground arcuate groove 51 can come into close contact, without any gap, with the outer periphery of the seal member 46 which slides on the inner surface of the ground arcuate groove 51 and which has an arcuate shape of the radius r, thereby inhibiting the leakage of the vapor from the outer periphery of the seal member 46.

A tool mark of the arcuate groove 51 after being cut by a ball end mill or the like, and before being ground extends in a lengthwise direction of the arcuate grove 51. For this reason, if the expanding machine M is operated with the tool mark remaining as it is, the vapor is liable to leak from the gap between the tool mark and the outer periphery of the seam member 46. However, the tool mark itself is reduced in size by carrying out the grinding operation using the forming grindstone 81. In addition, the direction of a new tool mark formed by the forming grindstone 81 (namely, the direction of the rotating surface of the forming grindstone 81) is parallel to the seal member 46. Therefore, the gap is difficult to form between the tool mark and the outer periphery of the seal member 46, and thus, it is possible to effectively prevent the leakage of the vapor from the outer periphery of the seal member 46.

After grinding of the arcuate groove 51 with respect to the work W has been completed in the above manner, a flat mating surface of the circular flange 13*a* of the work W, the first flat face 52, the second flat face 53 and the like of the work W can be cut, for example, by an end mill mounted on the spindle 87 or 89 of the second spindle stock 78 or the third spindle stock 79. The work W can be further ground by a disk-shaped grindstone. In addition, a bolt bore in the circular flange 13*a* can be cut by a drill, and the inner surface of the hollow bearing sleeve 13*c* can be cut by a cutting tool.

In this way, various types of processing of the work W other than the grinding of the arcuate groove 51 can be conducted with the work remaining fixed to the indexer 91. Therefore, labor for attaching and detaching the work W is not required. This leads to an enhanced operability. In addition, any other processing of the work W can be conducted with the same processing standard as the standard for the grinding of the arcuate groove 51. This leads to an enhanced processing accuracy.

A second embodiment of the present invention will now be described with reference to FIG. 9.

Whereas the arcuate groove 51 in the work W (see FIG. 4) in the first embodiment is linearly symmetrical with respect to the long axis L1 and the short axis L2 passing through the axis L, an arcuate groove 51 in a work W in the second embodiment is non-symmetrical with respect to the long axis L1 and the short axis L2 passing through the axis L, but is point-symmetrical with respect to the axis L. Namely, when portions of the work W lying on one side of the long axis L1 and the short axis L2 is rotated through 180°, they are superposed on each other. Even in the second embodiment, the vanes 44 are arranged radially about the axis L. Therefore, when the vanes 44 are rotated about the axis L, they are moved on a plane P extending through the axis L. Accordingly, when the arcuate groove 51 is ground by a forming grindstone 81, an inner surface of the arcuate groove 51, with which seal members 46 of the vanes 44 contacts, can be formed into an exact circle having a radius R by moving the rotating surface of the forming grindstone 81 along the plane P. Thus, the leakage of vapor is thereby suppressed.

Figure 9:
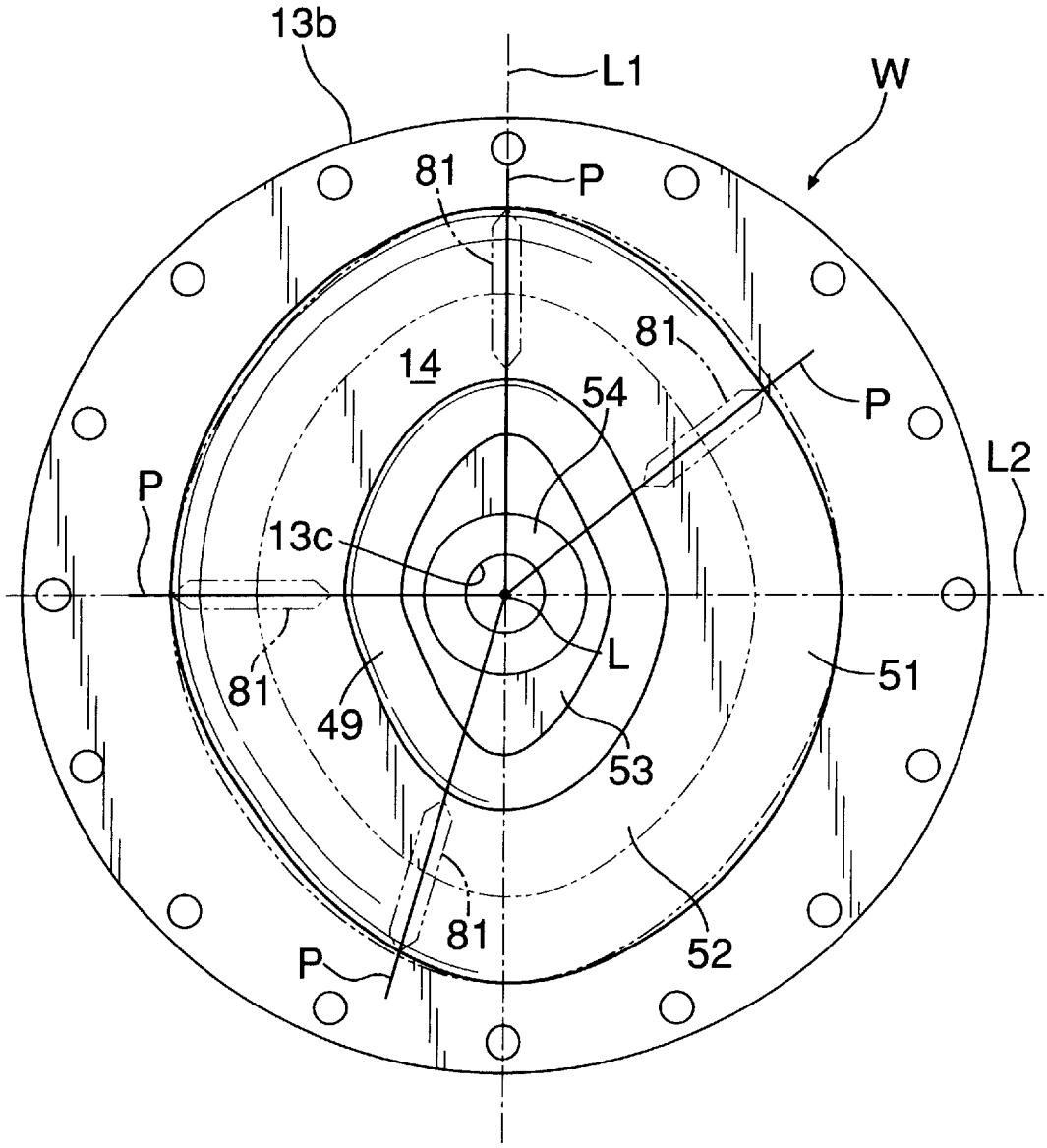
FIG. 9 is a front view of a second half casing of an expanding machine according to a second embodiment.

Because the rotating surface of the forming grindstone 81 is always matched with the plane P during grinding of the arcuate groove 51, the arcuate groove 51 having a shape shown in FIG. 9 can be ground only by reciprocally moving the work W in the Y-axis direction while rotating the work W about the C-axis in a state in which the forming grindstone 81 has been fixed within the Y-Z plane without the movement of the tool table 76 in the X-axis direction. The arcuate groove 51 in the second and fourth quadrants in FIG. 9 is small in distance from the axis L. Furthermore, the arcuate groove 51 in the first and third quadrants in FIG. 9 is large in distance from the axis L. Therefore, the relationship of the distance of movement of the work W in the Y-axis direction to the rotation of the work W about the C-axis is varied between when the arcuate groove 51 in the first and third quadrants is ground and when the arcuate groove 51 in the second and fourth quadrants is ground.

Figure 10:
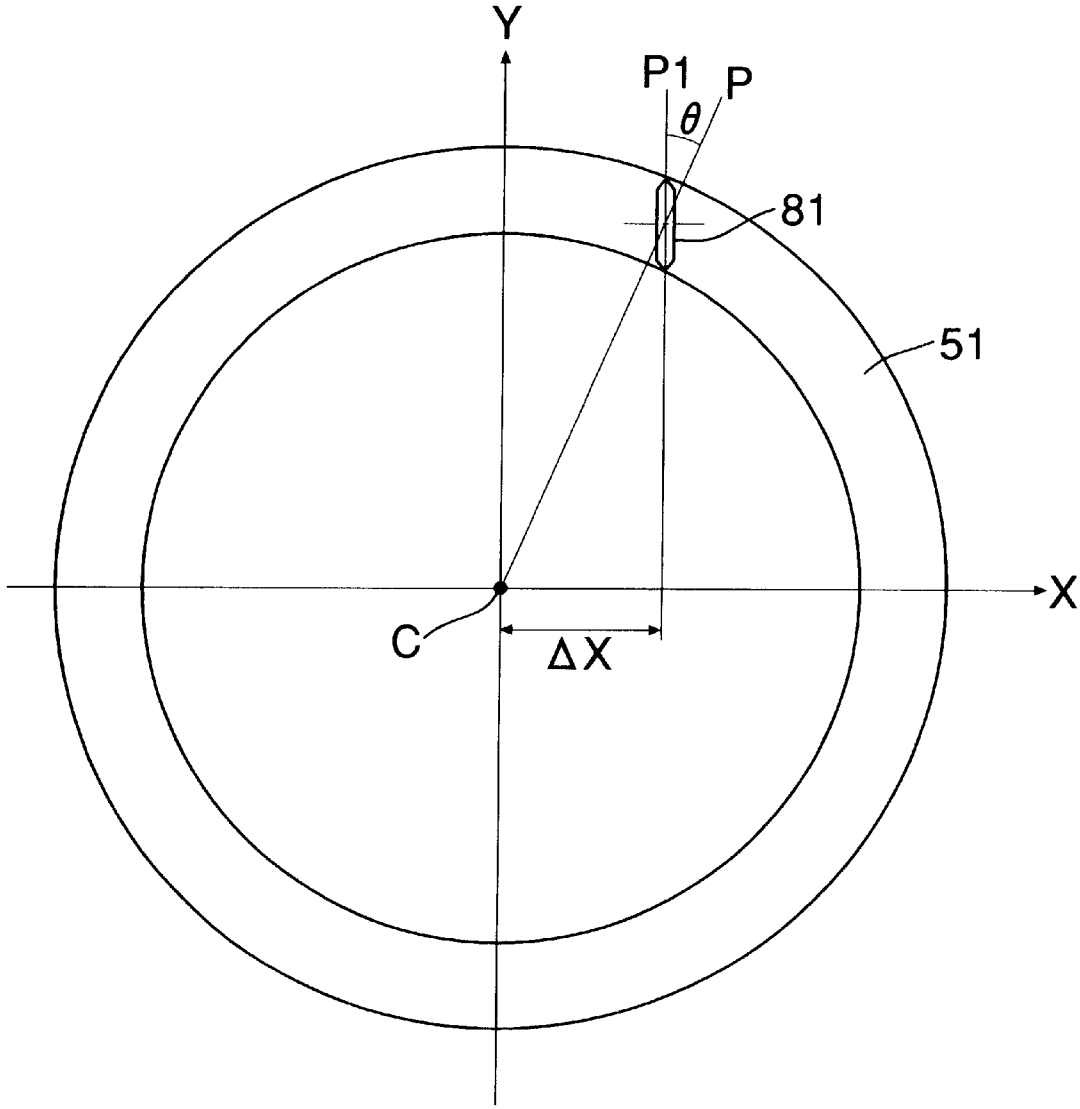
FIG. 10 is a diagram explaining the operation when a forming grindstone is displaced in a Z-axis direction.

A third embodiment of the present invention will now be described with reference to FIG. 10.

In the third embodiment, the operation upon the movement of the tool table 67 in the X-axis direction will be described. To facilitate the understanding, the forming grindstone 81 is fixed at a location displaced by a distance $\Delta X$ in the X-axis direction from the Y-Z plane passing through the C-axis. When the work W is fixed in the Y-axis direction in this state and rotated about the C-axis, the forming grindstone 81 is relatively moved to trace the arcuate groove 51 circular about the C-axis. On a plane P1 including the rotating surface of the forming grindstone 81, the sectional shape of the arcuate groove 51 becomes an arc of a circle having a radius r. The sectional shape of the arcuate groove 51 on a plane P passing through the C-axis is a portion of an ellipse rather than an arc.

Thus, the sectional shape of the arcuate groove 51 on the plane P passing through the C-axis can be changed from the arc of the circle to a portion of the ellipse by displacing the forming grindstone 81 in the X-axis direction from the Y-Z plane passing through the C-axis. In other words, the direction of the plane P1 on which the sectional shape of the arcuate groove 51 assumes the arc of the circle can be inclined by any angle $\theta$ with respect to the plane P perpendicular to a tangent direction of the arcuate groove 51.

In the first and second embodiment described above, since the axis L of the work W is matched with the C-axis, the grinding of the arcuate groove 51 could be conducted only by fixing the grindstone 81 on the Y-Z plane passing through the C-axis, and moving the work W in the Y-axis direction, while rotating the work W about the C-axis. However, when the work W is supported on the chuck 92 so that the axis L of the work W is not matched with the C-axis, it is impossible to conduct the grinding of the arcuate groove 51 only by moving the work W in the Y-axis direction, while rotating the work W about the C-axis. In this case, the grinding of the arcuate groove 51 is not possible without moving the forming grindstone 81 synchronously with the rotation of the work W about the C-axis and with the movement of the work W in the Y-axis direction.

Figure 11:
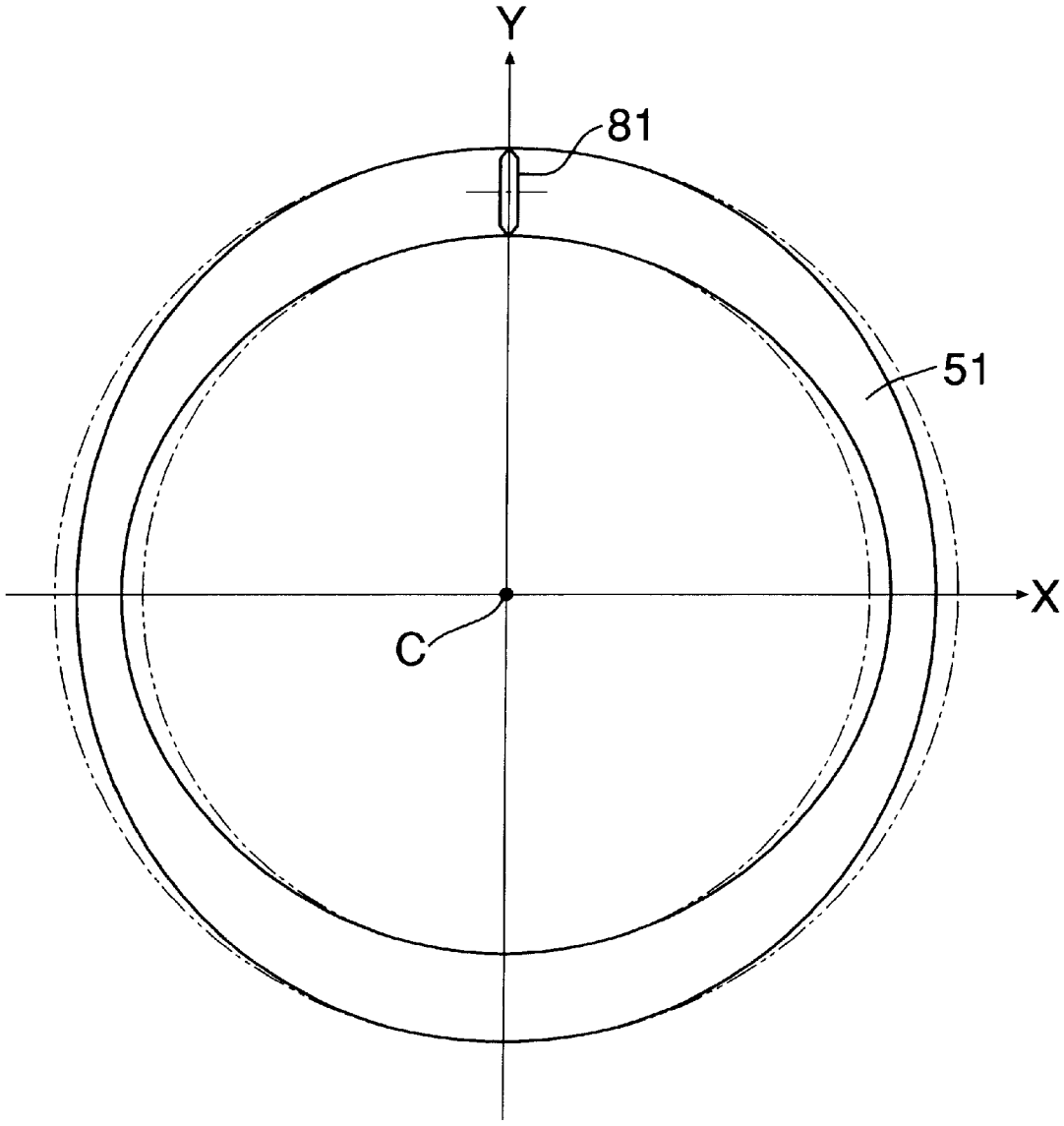
FIG. 11 is a diagram illustrating a fourth embodiment of the present invention.

A fourth embodiment of the present invention will now be described with reference to FIG. 11.

In the fourth embodiment, the operation in the movement of the tool table 67 in the Z-axis direction will be described. To facilitate the understanding, the forming grindstone 81 is fixed on the Y-Z plane passing through the C-axis. When the work W is rotated about the C-axis in this state, the forming grindstone 81 is relatively moved to trace the arcuate groove 51 circular about the C-axis. When the forming grindstone 81 is moved in the Z-axis direction toward the work W at this time, the depth and width of the arcuate groove 51 is increased. On the other hand, when the forming grindstone 81 is moved in the Z-axis direction away from the work W, the depth and width of the arcuate groove 51 is decreased.

From the forgoing, it is possible to grind any arcuate groove 51 of various shapes by appropriately combining the rotation of the work W about the C-axis, the movement of the work W in the Y-axis direction, the movement of the forming grindstone 81 in the X-axis direction, and the movement of the forming grindstone 81 in the Z-axis direction with one another. As such, the above combination may provide substantially enhanced general-purpose properties.

The half casings 12 and 13 of the expanding machine M have been illustrated as the work W in the embodiments. However, the present invention is applicable to any other work W. The work W supported on the indexer 91 during the grinding is being not unnecessarily rotated, and may be temporarily stopped or may be always at stoppage.

Although the embodiments of the present invention have been described in detail, various modifications in design may be made without the subject matter of the present invention.

What is claimed is:

1. A work processing method for processing an arcuate groove defined in a surface of a work so that an arc of a circle having a given radius smoothly continues, the method using:

a forming grindstone to be rotated about a rotary shaft parallel to an X-axis and having the same radius as the arc of the circle;

a tool table movable in the X-axis direction and in a Z-axis direction perpendicular to the X-axis with the forming grindstone supported thereon; and an indexer mounted to support the work such that the indexer is opposed to the forming grindstone in the Z-axis direction, and the indexer is moved in an Y-axis direction perpendicular to the X-axis and the Z-axis, and rotates the work about a C-axis, wherein the method comprising the steps of:

synchronizing the rotation of the work about the C-axis, a movement of a grindstone in the Z-axis direction, and at least one of a movement of the work in the Y-axis direction and a movement of the forming grindstone in the X-axis direction, and moving the forming grindstone to trace the arcuate groove.

2. The work processing method according to claim 1, wherein the movement of the work in the Y-axis direction is synchronized with the movement of the forming grindstone in the X-axis direction.

3. The work processing method according to claim 1, wherein the movement of the forming grindstone in the X-axis direction is synchronized with the movement of the work in the Y-axis direction.

4. The method according to claim 1, wherein both the movement of the work in the Y-axis direction and the movement of the forming grindstone in the X-axis direction are synchronized.

5. The work processing method according to any of claims 1 to 4, further comprising the steps of:

mounting a tool other than the forming grindstone on the tool table; and processing the work supported on the indexer by the tool.

6. The work processing method according to claim 5, wherein said tool is any one of a grindstone tool, a milling-type tool and a lathe-type tool.

* * * * *